United States Patent [19]

Watanabe

[11] 4,370,119

[45] Jan. 25, 1983

[54] POWDER PRESS

[75] Inventor: Takashi Watanabe, Iwatsuki, Japan

[73] Assignee: Tamagawa Kikai Kabushiki Kaisha, Tokyo, Japan

[21] Appl. No.: 300,972

[22] Filed: Sep. 9, 1981

[30] Foreign Application Priority Data

Sep. 9, 1980 [JP] Japan ..... 55-124798

[51] Int. Cl.[3] ..... B30B 7/02; B30B 11/02; B30B 15/00

[52] U.S. Cl. ..... 425/352; 425/214; 425/338; 425/78

[58] Field of Search ..... 425/214, 78, 338, 352

[56] References Cited

U.S. PATENT DOCUMENTS

| | | | |
|---|---|---|---|
| 2,499,980 | 3/1950 | Stokes et al. | 425/78 |
| 2,823,419 | 2/1958 | Winters et al. | 425/78 |
| 3,168,759 | 2/1965 | Johannigman | 425/78 |
| 3,172,156 | 3/1965 | Belden | 425/78 |
| 3,191,232 | 6/1965 | Haller | 425/78 |
| 3,337,916 | 8/1967 | Smith | 425/78 |
| 3,464,089 | 9/1969 | Smith | 425/338 |
| 3,664,784 | 5/1972 | Sibley | 425/78 |
| 3,802,818 | 4/1974 | Watanabe et al. | 425/214 X |
| 3,868,201 | 2/1975 | Jacobson et al. | 425/78 |

*Primary Examiner*—J. Howard Flint, Jr.
*Attorney, Agent, or Firm*—Wenderoth, Lind & Ponack

[57] ABSTRACT

A powder press has a fixed plate secured to a frame and having mounted thereon stops which are adjustably movable up and down. The stops are in abutting contact with rotatable stop rods which are threadedly mounted to an intermediate plate carrying a floating punch and which receives downward thrust during the process of compaction. The stop rods are locked against rotation by locking members during compaction and released therefrom upon descent of ejector rods which press down the intermediate plate and a die plate at the time of the ejection of the compact. The released stop rods rotate about their own axes to permit the descent of the intermediate plate. The abutting stop rods and stops make no large space requirement, and their rigidity is high.

6 Claims, 6 Drawing Figures

POWDER PRESS

BACKGROUND OF THE INVENTION

The present invention relates to a floating die-type powder press and more specifically to means for stopping and releasing its floating punch.

Some powder presses employ a plurality of punches in order to form compacts of varying heights, flange thicknesses, etc., by means of the same die set. Such presses comprise a die proper, and one or more lower punches to impart a desired bottom contour to the compact, together with or without a core rod to create a central bore in the product.

In such powder presses the powder material is compacted in the cavity of the die set by the descending upper punch. The die, lower punches, and core rod are maintained in their preassigned relative positions by appropriate stop means during the compaction of the material. The compacted product is ejected out of the die cavity with the stop means held inoperative. During the ejection of the compact the stop means are unlocked by and set free from their locking members when the compact is ejected to such an extent that the top surfaces of the lower punches become coplanar with that of the die. Thereafter the lower punches and the die are lowered, with their top surfaces maintained in coplanar relationship with each other, to the final position where the product is withdrawn.

Although a variety of stop devices have been suggested, each has a problem in regard to reliability of operation, ease of manufacture, and size. No truly satisfactory device has been available.

Conventional stop devices comprise either stop slides with planar load-bearing surfaces, bell cranks, or wedges, which are all engaged and disengaged to stop and release the floating punch or punches.

The stop device with the bell cranks is such that the bell cranks are pivotally mounted to a plate carrying a floating punch. The bell cranks bear the loads by abutting against fixed supports and are disengaged therefrom as a pusher pin acts on one of the arms of each bell crank. Because of the pivotal motion of the bell cranks, however, their pivot portions and surfaces of contact with the fixed supports must be curved, and their load-bearing surfaces make line contact with the supports. Thus, by reason of their low rigidity, the bell crank-type stop device is not suitable for high pressure presses.

The stop devices with the planar stop slides and wedges are more stable structurally and so capable of bearing greater loads. However, since the stop slides or wedges must travel laterally on their stationary support for disengagement, they require considerable space for such lateral displacement. Further the wedge-type stop device is mechanically complex and demands large space in the press, causing a decrease in its rigidity. The press will become expensive if its parts are made stronger to compensate for such decreased rigidity. Because of its large size, moreover, it lends itself to use with presses having no more than two floating punches.

SUMMARY OF THE INVENTION

It is therefore an object of the present invention to provide a powder press having means for stopping and releasing a floating punch or punches, which means are simplified in construction, are capable of withstanding large loads, and require minimal space.

The powder press in accordance with the invention comprises a fixed plate secured to a frame, a die plate holding a die in which powder material is to be compacted, the die plate being movable up and down, at least one intermediate plate disposed between the fixed plate and the die plate and movable up and down, an upper punch coupled to an upper ram and movable up and down therewith for pressing down the powder material in the die, at least one floating punch mounted to the intermediate plate and coacting with the upper punch to pack the powder material in the die by exerting an upward pressure thereon, stops mounted to the fixed plate so as to permit adjustment of their vertical position, rotatable stop rods threadedly engaged with the intermediate plate carrying the floating punch and adapted to make abutting engagement with the stops during the compaction of the powder material for bearing the load thereon, locking members for locking the stop rods against rotation during the compaction of the powder material, and ejector rods for disengaging the stop rods from the locking members and pressing down the die plate and the intermediate plate at the time of the ejection of the compact.

The features and utility of the invention will become more apparent from the description of a preferred embodiment taken together with the accompanying drawings.

DETAILED DESCRIPTION OF THE INVENTION

Figure 1:
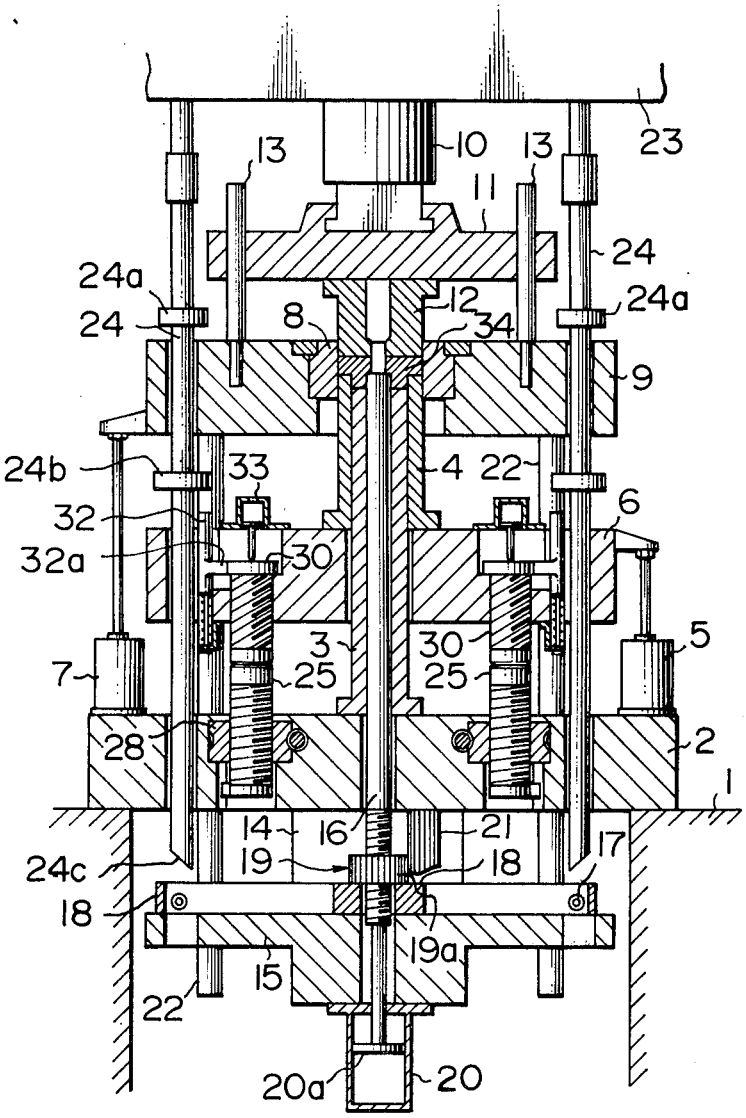
FIG. 1 is a vertical sectional view of the powder press constructed in accordance with the present invention, the press being shown in a state just after the compaction of the powder material.

With reference to FIG. 1, a frame 1 forming a part of the powder press in accordance with this invention has a plate 2 secured thereto, and centrally on this fixed plate a first lower punch 3 is immovably erected. A floating, second lower punch 4 is sleeved upon the upper portion of the first lower punch 3 and fixedly mounted on an intermediate plate 6 supported over the fixed plate 2 by an air cylinder 5 erected thereon. Over the intermediate plate 6 there is disposed a die plate 9 which is supported by another air cylinder 7 and which has mounted centrally therein a die 8 partly receiving the second lower punch 4. Arranged further over these members is an upper punch plate 11 in engagement with an upper press ram 10 for up-and-down motion therewith. The upper punch plate 11 carries an upper punch 12 on its underside.

Planted in the die plate 9 are a plurality of guide rods 13 extending upwardly therefrom through the upper punch plate 11 for guiding the up-and-down motion of the upper punch plate 11.

The fixed plate 2 is rigidly coupled, via a connector 14, to a fixed table 15 lying thereunder. The fixed table 15 has mounted thereon a core rod 16 extending upwardly therefrom through the first lower punch 3 and having its upper end projecting into the die 8. Also mounted on the fixed table 15, for transverse or lateral movement within limits, are a pair of stop slides 18 which have rollers 17 rotatably mounted thereon and which are energized by a spring (not shown) toward each other. These stop slides are engaged with a stop 19, which is mounted on the screw-threadedly engaged with the lower part of the core rod 16, for supporting the core rod. The core rod 16 extends downwardly through the fixed table 15 and is coupled to a piston 20*a* of air cylinder means 20 attached to the underside of the fixed table 15. The stop 19 threaded onto the lower part of the core rod 16 is gear toothed peripherally, and this geartoothed portion 19*a* meshes with a splined shaft 21. With the rotation of this splined shaft 21, therefore, the stop 19 rotates to adjustably vary the axial position thereof with respect to the core rod 16. The vertical position of the core rod 16 can thus be adjusted. These stop 19, splined shaft 21 and stop slides 18 constitute in combination the mechanism for adjusting the vertical position of the core rod.

Attached to the die plate 9 are guide rods 22 extending downwardly therefrom through the intermediate plate 6, the fixed plate 2 and the fixed table 15, for guiding the up-and-down motion of the intermediate plate 6 and the die plate 9.

Within an upper frame 22, which is provided with the upper press ram 10 and so forth, there are mounted a crank mechanism, a cam mechanism and the like (not shown). Suspended from this upper frame 23 are ejector rods 24 which are to be pressed down by the unshown cam mechanism in a timed manner. The ejector rods 24 extend downwardly through the die plate 9, the intermediate plate 6 and the fixed plate 2, and are each provided with a collar 24*a*, located above the die plate 9, for abutment against the upper surface of the die plate 9 at the time of the ejection of the molding upon completion of compaction. Also formed on each ejector rod is a second collar 24*b*, located above the intermediate plate 6, for abutment against the top surface of the intermediate plate 6 when the top surface of the die 8 becomes flush with the upper surface of the second lower punch 4 during the ejection of the molding. Each ejector rod 24 has a slanting bottom surface 24*c* for engagement with one of the rollers 17 of the stop slides 18 when the ejector rod is lowered to a predetermined degree. The slanting bottom surfaces 24*c* of the ejector rods function to move the stop slides 18 away from each other against the force of the unshown spring and hence to release the stop 19 therefrom.

The fixed plate 2 has mounted thereon a pair of externally threaded stops 25 capable of adjustably moving up and down relative to the fixed plate. As illustrated on an enlarged scale in FIG. 2, the fixed plate 2 has bores 26 extending vertically therethrough, and the stops 25 are loosely received in these bores 26, with their top end portions projecting upwardly of the fixed plate 2. Each stop 25 has a key 25*a* at its bottom end which is fitted in a keyway 26*a* formed in the surface bounding one of the bores 26, so that the stop is movable up and down relative to the fixed plate 2. Further, each externally threaded stop 25 meshes with an internally threaded member 28 which is mounted in the fixed plate 2 for rotary motion by a worm 27. Thus, with the rotation of the internally threaded members 28 by the respective worms 27, the stops 25 move axially, or up and down, for protrusion from the fixed plate 2 to adjustably variable degrees.

Figure 2:
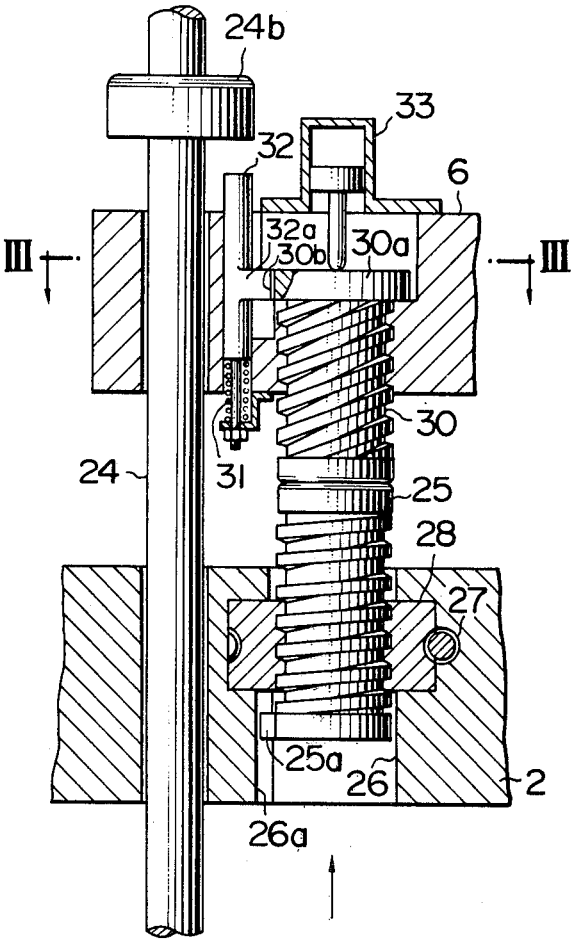
FIG. 2 is an enlarged, fragmentary, vertical sectional view showing in particular part of the stop means incorporated in the powder press of FIG. 1.
Figure 3:
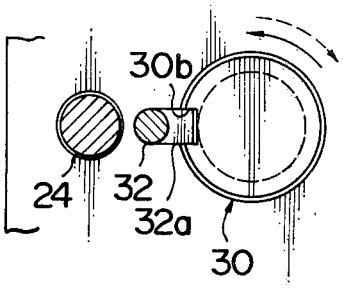
FIG. 3 is a horizontal sectional view taken along the line III—III of FIG. 2.

Screw-threadedly engaged with the intermediate plate 6 are stop rods 30 which are in axial alignment with the respective stops 25 and which are multithreaded with an angle greater than the angle of friction. On one side of each stop rod 30, and under the collar 24*b* of each ejector rod 24, there is disposed a locking rod 32 which has its upper end portion projecting from the top surface of the intermediate plate 6 to a predetermined degree under the bias of a spring 31. The locking rod 32 is formed integral with a detent 32*a* which is engageable, when the locking rod 32 projects upwardly from the intermediate plate 6 to the predetermined degree, in a recess 30*b* formed in a flange 30*a* at the top end of the stop rod 30. The detent 32*a* on engagement in the recess 30*b* locks the stop rod 30 against rotation. The intermediate plate 6 has mounted thereon air cylinder means 33 located above the stop rods 30 to bias the same downwardly, as illustrated in FIGS. 2 and 3.

FIG. 1 shows the press in a condition upon completion of the compacting of the powder material. In this condition, with the descent of the upper punch 12, the second lower punch 4 is thereby lowered via the compacted powder material. The intermediate plate 6 is thus lowered against the force of the air cylinder 5, with the result that the stop rods 30 make abutting engagement with the stops 25 to limit the descent of the intermediate plate 6. The powder has been compacted in the space bounded by the inside surfaces of the upper punch 12, first lower punch 3, second lower punch 4 and die 8 and by the core rod 16. The reference numeral 34 in FIG. 1 denotes the compact.

Upon completion of compaction the upper punch 12 is raised via the upper punch plate 11 and so forth, preparatory to the ejection of the compact.

As the upper punch 12 is raised upon completion of compaction as above, the cam mechanism in the upper frame 23 operates to depress the ejector rods 24 at an appropriate time. The descending ejector rods 24 engage the die plate 9 with their collars 24*a* and so move the die plate downwardly.

Figure 4:
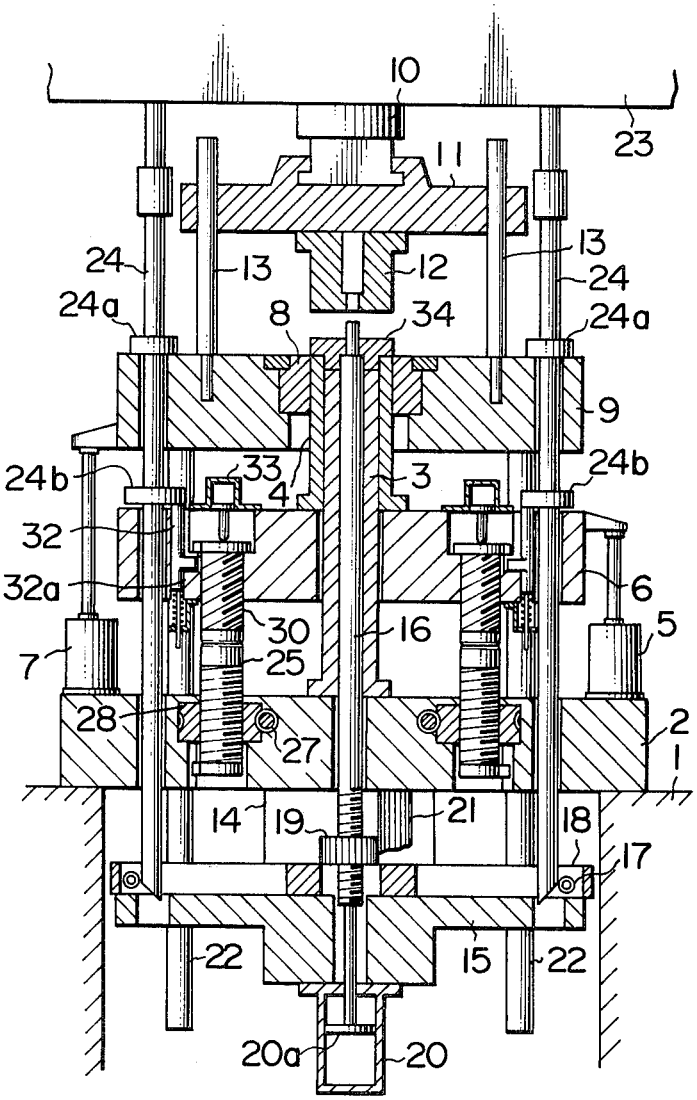
FIGS. 4 and 5 are vertical sectional views showing the powder press of FIG. 1 in different phases of operation.

When the top surface of the die 8 comes near the top surface of the second lower punch 4, the collars 24*b* on the ejector rods 24 engage the locking rods 32 and cause their descent against the forces of the springs 31, with the result that the detents 32*a* move out of the recesses 30*b* in the stop rods 30. Thereafter, as the top surface of the die 8 becomes flush with that of the second lower punch 4, the collars 24*b* on the ejector rods 24 come into abutment against the top surface of the intermediate plate 6, so that the intermediate plate starts descending with the die plate 9, as illustrated in FIG. 4. The stop rods 30 are now free to rotate relative to the intermediate plate 6 because the detents 32*a* of the locking rods 32 are disengaged as aforesaid from the recesses 30*b* in the stop rods 30. Further the threads of the stop rods 30 are angled greater than the angle of friction, and the air in the cylinder means 33 is now vented. All these reasons combine to make it possible for the stop rods 30 to revolve with the descent of the intermediate plate 6; that is, the stop rods do not interfere with such descent of the intermediate plate.

Figure 5:
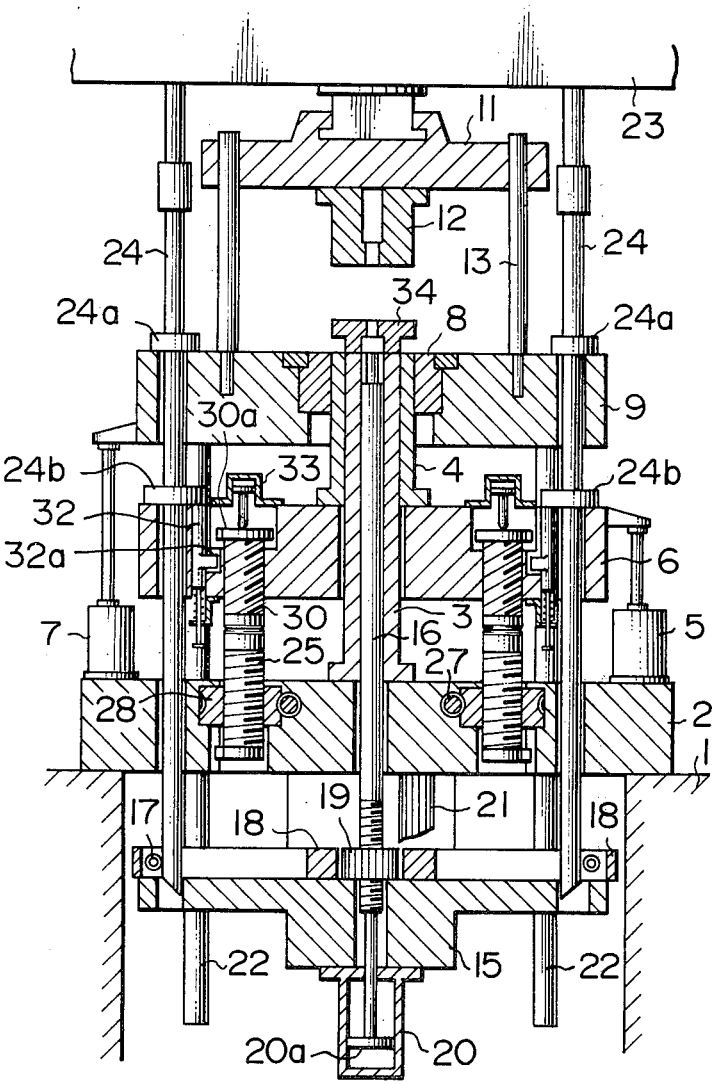

In this manner the die plate 9 is lowered with the intermediate plate 6 until the top surface of the first lower punch 3 becomes flush with that of the die. Also, with the descent of the die plate 9, the slanting bottom surfaces 24*c* of the ejector rods 24 cause the stop slides 18 to travel apart from each other, with the consequent release of the stop 19. At this time, pressurized air is made to act upon the upper surface of the piston 20*a* of the air cylinder means 20, thereby causing the same to pull the core rod 16 downwardly. Now the ejection of the compact 34 is completed as in FIG. 5.

The compact 34 is withdrawn from the press by means of a feeder (not shown). Then, with the subsequent ascent of the ejector rods 24, the intermediate plate 6 and the die plate 9 are both raised by the air cylinders 5 and 7 to the prescribed positions for the reception of the next charge of powder material. Pressed down by the piston rods of the air cylinder means 33, the stop rods 30 revolve until their flanges 30*a* are bottomed in the depressions in the intermediate plate 6. The stop rods 30 are raised with the intermediate plate 6, and in its predetermined position the detents 32*a* of the locking rods 32 become engaged in the recesses 30*b* in the stop rods 30 thereby locking the stop rods 30 against rotation. The core rod 16 is raised by the air cylinder means 20 for the next molding operation.

Figure 6:
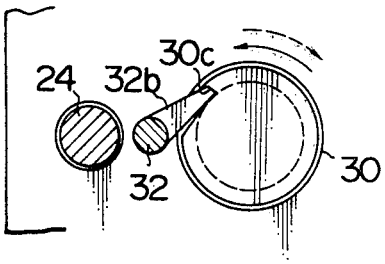
FIG. 6 is a view similar to FIG. 3 but showing a modified example.

While only one intermediate plate is used in the foregoing embodiment, stop means similar to those disclosed herein find use in powder presses employing a plurality of intermediate plates. It is of course recognized, moreover, that the several intermediate plates may be lowered in any suitable sequence chosen in accordance with the particular shape of the compact formed in such presses. FIG. 6 illustrates another example of means for locking each stop rod 30 against rotation. The flange 30*a* of each stop rod 30 has a recess 30*c* formed therein. To be engaged in this recess is a locking pawl 32*b* formed on each locking rod 32 and extending tangentially of the stop rod 30. It is also possible to provide an extensible member between the intermediate plate and the fixed plate so as to surround the stop rods and the stops, in order to prevent the attachment of foreign matter to the threads of the stop rods and the like.

According to the present invention, as has been explained hereinbefore, the stops are provided to the fixed plate so as to permit adjustment of their vertical positions, and the stop rods are threadedly engaged with the intermediate plate for bearing the downward load of the press by making end-to-end abutment against the stops during the compaction of the powder material. As the stop rods are disengaged from the locking members, the stop rods are permitted to move relative to the intermediate plate, thereby releasing the latter. Thus the stop means according to the invention require minimal space. Further the stop means find application to those presses which have a plurality of intermediate plates carrying as many floating punches, if such stop means for the floating punches as the stops 25, stop rods 30 and locking rods 32*a* are disposed in angularly spaced positions. It will also be appreciated that since the stops and the stop rods abut against each other with their flat ends, they can well withstand great loads with sufficient rigidity.

What is claimed is:

1. A floating die-type powder press comprising a fixed plate secured to a frame, a die plate holding a die in which powder material is to be compacted, said die plate being movable up and down, at least one intermediate plate disposed between said fixed plate and said die plate and movable up and down, an upper punch coupled to an upper ram and movable up and down therewith for pressing down the powder material in said die, at least one floating punch mounted to said intermediate plate and coacting with said upper punch to compact the powder material in said die by exerting an upward pressure thereon, stops mounted to said fixed plate so as to permit adjustment of their vertical position, rotatable stop rods threadedly engaged with said intermediate plate carrying said floating punch and adapted to make abutting engagement with said stops during the compaction of the powder material for bearing the load thereon, locking members for locking said stop rods against rotation during the compaction of the powder material, and ejector rods for disengaging said stop rods from said locking members and pressing down said die plate and said intermediate plate at the time of the ejection of the compact.

2. A powder press as claimed in claim 1, further comprising at least one additional intermediate plate, and wherein stop means are disposed in angularly spaced positions between said intermediate plates and said fixed plate for stopping the floating punches.

3. A powder press as claimed in claim 1, wherein said stop rods are multithreaded with an angle greater than the angle of friction.

4. A powder press as claimed in claim 1, wherein each of said locking members has a detent engageable in a recess formed in a flange of one of said stop rods, and wherein said locking members are mounted to said intermediate plate for up-and-down motion.

5. A powder press as claimed in claim 1, wherein said fixed plate has mounted thereon a fixed punch extending through said intermediate plate and said floating punch into said die, wherein a core rod slidably extends through said fixed punch, and wherein means are provided for adjustably varying the vertical position of said core rod.

6. A powder press as claimed in claim 5, wherein said adjustably varying means comprise a stop threadedly engaged with said core rod, and stop slide means engageable with said stop and movable horizontally, said stop slide means disengaging said stop by sliding horizontally in response to the descent of said ejector rods.

* * * * *